United States Patent [19]

Lander

[11] 4,251,818

[45] Feb. 17, 1981

[54] CORNER REFLECTOR CIRCULARLY POLARIZED ANTENNA

[75] Inventor: Victor A. Lander, Highland Park, N.J.

[73] Assignee: Blonder-Tongue Laboratories, Inc., Old Bridge, N.J.

[21] Appl. No.: 106,765

[22] Filed: Dec. 26, 1979

[51] Int. Cl.[3] ..... H01Q 19/13

[52] U.S. Cl. ..... 343/819; 343/912

[58] Field of Search ..... 343/818, 819, 833, 834, 343/908, 912

[56] References Cited

U.S. PATENT DOCUMENTS

| | | | |
|---|---|---|---|
| 2,714,659 | 8/1955 | Johnson et al. | 343/818 |
| 2,897,496 | 7/1959 | Woodward | 343/818 |

*Primary Examiner*—Eli Lieberman

*Attorney, Agent, or Firm*—Rines and Rines, Shapiro and Shapiro

[57] ABSTRACT

A novel grid-type corner reflector adapted to direct circularly polarized waves is described, involving critical and uneven grid reflector rod spacings and fed dipole tilt angles, with adaptation for circular passive directors, as well.

10 Claims, 4 Drawing Figures

CORNER REFLECTOR CIRCULARLY POLARIZED ANTENNA

Figure 1:
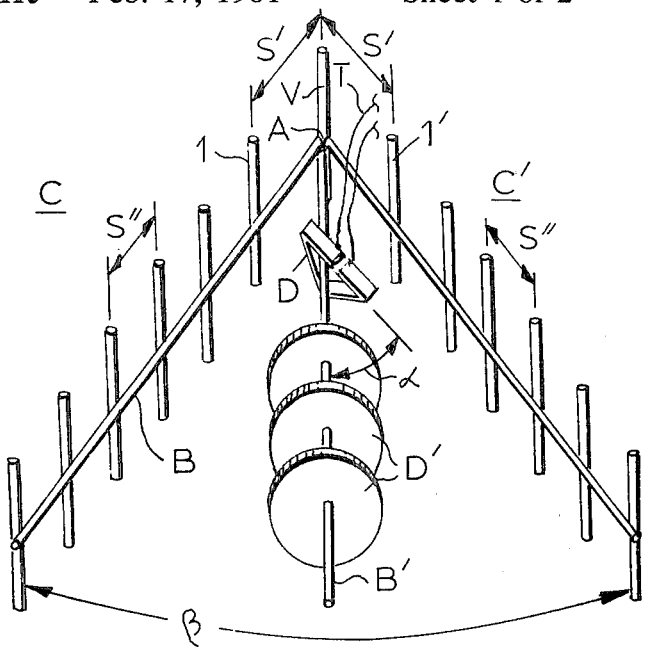

The present invention relates to corner reflector antenna systems, being more particularly directed to such systems adapted for circular polarization.

While the advantages of circular polarization, particularly in ultra-high-frequency television communication, have been recognized ("Circular Polarization in Television Broadcasting", Proceedings of 29th Annular Broadcast Engineering Conference, Apr. 6–9, 1975), antennas for generating and/or receiving the same have been complex and relatively costly to build and adjust. Though corner reflectors have long been recognized as efficient directional aids, and when constructed of grids of wires have been recognized as of relatively low cost, such have been applied to linear polarization and have not been seen as specifically applicable to circularly polarized operation in view of the linear polarization of the grid wires and the expectation that wires oriented parallel to one polarization axis, say vertical, were not expected effectively to reflect complementary polarization electric vectors, say horizontal. (See, for example, Wilson, A. C. et al, "Radiation Patterns of Finite-Size Corner-Reflector Antennas," Trans. IRE, AP-8, N2, pp. 144–157, March, 1960; and Hirasawa K., "A Study on a Reactively Loaded grip-type corner Reflector Antenna", Trans. of IECE of Japan, E-61, 6, p. 476, June 1978). While the concept of using a solid conducting corner reflector with circular polarization has been described (Woodward, O. M., "A Circularly-Polarized Corner Reflector Antenna," Trans. IRE, AP-5,N3, pp. 290–297, July, 1957), this again has heretofore contraindicated the use of a simple open-wire grid of parallel rods, and has been void of any expectation that some kind of parasitic direction system could possibly be used with such an arrangement to obtain improved circular polarization gain or directivity or other performance characteristics. And though the art is replete with studies of the effect of dipole orientation and reflector apex angle in linear polarization systems (Kloppenstein, R. W., "Corner Reflector Antennas with Abritrary Dipole Orientation and Apex Angle", Trans. IRE, AP-5,3, pp. 297–305, July, 1957), the adaptation of such to perform with circular polarization, and the necessary design criterea involved with circular polarization in corner reflectors has been relatively unexplored, probably because of the contra-indications above discussed.

In accordance with the present invention, on the other hand, it has been discovered that, with appropriately dimensioned and rather critically spaced parallel rods, a simple corner reflector can be constructed to operate most effectively with circular polarization, and can take advantage of parasitic director mechanisms, as well, to provide a highly desirable and excellently performing directional antenna, particularly, though by no means exclusively, adapted for UHF television reception.

An object of the invention, accordingly, is to provide a new and improved corner-reflector antenna system especially adapted for operation with circular polarization.

A further object is to provide such a novel antenna with highly practical features of low weight, reduced wind resistance and relatively low cost.

Other and additional objects will be hereinafter discussed and are more particularly delineated in the appended claims. In summary, however, from one of its important viewpoints, the invention embraces a corner-reflector circularly polarized antenna system having, in combination, a corner reflector comprising a pair of pluralities of spaced parallel rods diverging from and parallel to a vertex axis; dipole means connected with transmission line means and oriented in a plane substantially parallel to but at an acute tilt angle to said axis, forward of the same and on a further axis orthogonal to the vertex axis and substantially bisecting the corner reflector; the spacing between the parallel rods at the positions of each of the said pluralities of rods to the sides of the dipole being greater than other rod spacings and adjusted to provide appropriate virtual image dipole action in the reflection from the rods to generate circular polarization. Preferred details are hereinafter presented.

Figure 2:
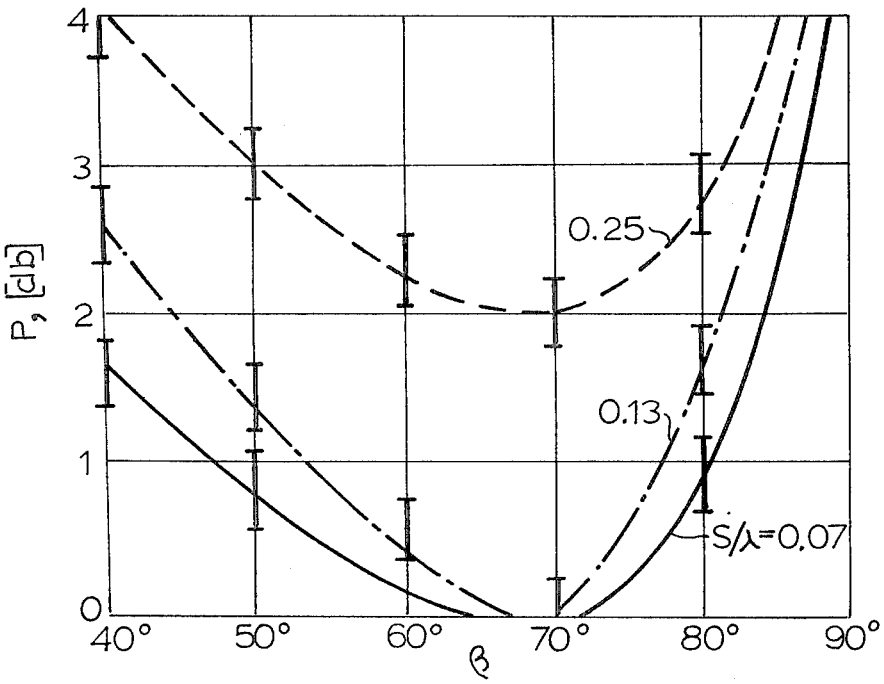
Figure 3:
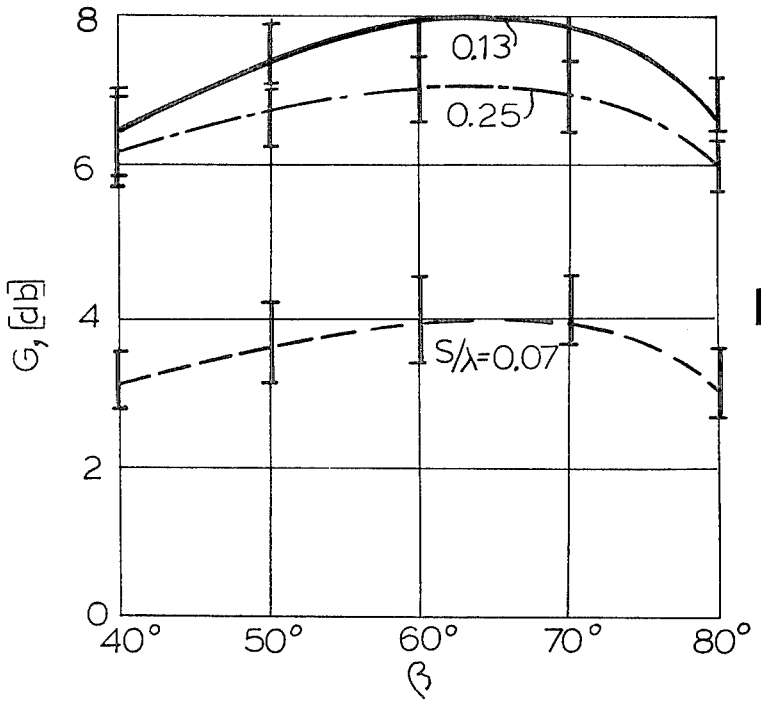
Figure 4:
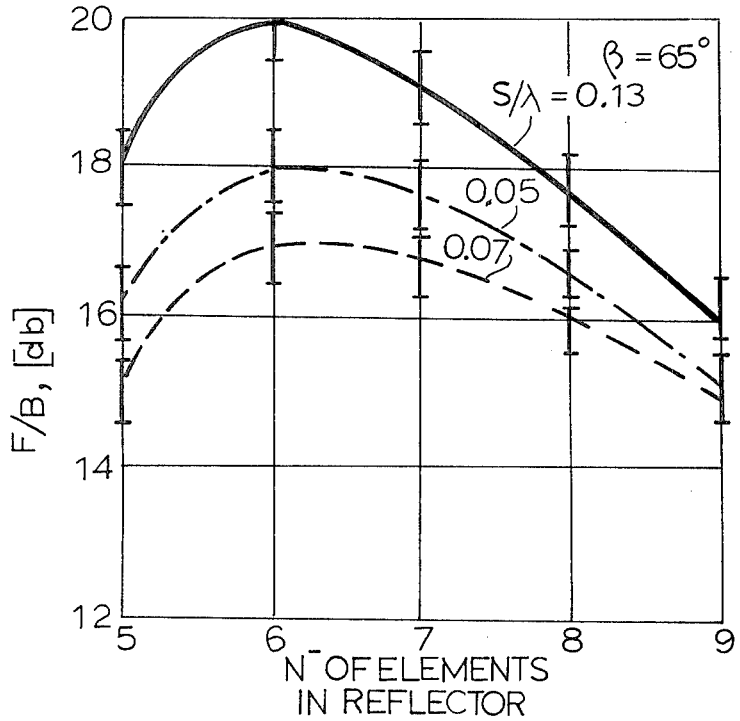

The invention will now be described in connection with the accompanying drawing, FIG. 1 of which is an isometric view of the antenna system of the invention in preferred and best mode form;

FIGS. 2 and 3 are experimentally derived graphs illustrating, respectively, optimum circularity or axial polarization ratio P and optimum gain G as a function of corner reflector apex angle; and FIG. 4 is a similar graph illustrating optimum front-to-back radiation pattern ratios F/B as a function of number of reflector grid rods.

Turning to FIG. 1, the antenna system is illustrated as oriented vertically, though it can equally well be used in other orientations, as well. The corner reflector is shown comprising a pair of pluralities of spaced parallel conductive grid reflector rods C and C′, diverging at an angle $\beta$ from a vertex axis rod V. In practical construction, the rods of the pluralities C and C′ may be centrally mounted in a V-shaped boom B, as of aluminum tubing or the like, holding the vertex rod V at the apex A of the "V", and with the reflector rods all of substantially the same length and substantially symmetrically extending above and below the boom B.

The dipole for the reflector is shown at D, preferably as of the folded dipole type with its terminals connected to the transmission line T, and supported forward of the vertex reflector rod V upon a further boom B′, again as of tubing, for example, extending forward from the apex A along the bisecting axis of the corner reflector and orthogonal to the vertex axis V. The dipole D is orientated in a plane substantially parallel to that of the drawing containing the vertex reflector rod V and is oriented at an acute angle $\alpha$ to the vertex axis (to the vertical, in FIG. 1).

In accordance with discoveries underlying the invention, if the appropriate orientations, dimensions and spacings are employed, the grid rods C and C′, though oriented vertically, can serve as effective reflecting surfaces for horizontal polarization components of electric field, as well as vertical; and through novel greater spacing S′ of the rods 1 and 1′ nearer the vertex reflector rod V than the preferably substantially equal smaller spacing S″ between the other rods, a remarkable balancing of the unbalanced nature of the folded dipole D and a simultaneous virtual image dipole action in the reflecting surfaces C and C′ has been found to take place to produce circular polarization operation of excellent axial ratio, gain, uniformity and other characteristics. Additionally, it has been found that appropriately shaped, dimensioned and positioned conducting surfaces D′ can be used on the boom B′, forward of the dipole D, to provide passive directivity functions for the circular polarization, as well.

Specifically, it has been determined that for a wavelength λ of the radio frequency to be used with the system, the length of the reflector rods should be substantially λ. The smaller spacing S″ between reflector rods of particular diameter and number necessary to cause the reflecting arrays C and C′ to work as reflectors of all polarizations has been found to be of the order of λ/10. With a dipole tilt angle α from the vertical of from about 25° to 30°, more or less, a corner reflector angle β of from about 65° to 70°, more or less, and a position of the dipole D along the boom B′ from about 0.13λ to λ/4 in front of the vertex reflector rod V, the greater spacing S′ between 1 and 1′ should be about λ/4, also-, to effect the novel results above-described. The larger the diameter of the reflector rods, moreover, the smaller the spacing S″ required to obtain the same circularity; or, otherwise stated, better circularity is obtained with reflector elements of greater diameter, for the same spacing.

If, moreover, passive conductive director circular discs D′ (or other conducting surfaces having adequate horizontal and vertical components such as wire rings or the like) of circumference of value about equal to λ are positioned at about λ/4 intervals further along the boom B′, improved directivity and gain can be achieved without destroying the circularity (axial ratio).

In connection with an antenna of the type shown in FIG. 1 designed for the 750–800 MHz UHF range, it was found that a rather sharply defined corner reflector angle β of about 68° enables a circularity P (ordinate in FIG. 2) of zero db, meaning a unity axial ratio of vertical-to-horizontal polarization components, for a rod spacing S″ of 0.13λ. The less sharp optimum and/or poorer circularity with spacings of less and greater values is clearly shown. The corresponding peaking of the gain G (db), compared with that of a linearly polarized dipole, is shown in the uppermost curve of FIG. 3; and optimum front-to-back ratio F/B (db) is similarly illustrated in the top curve of FIG. 4, with an optimal number of about six reflector rods in each wing C and C′ indicated, as plotted along the abscissa.

Turning to the improvement with passive directors, as before stated, the preferred directors D′ were made of solid metal discs (λ in circumference) in view of their ease of manufacture and installation compared with wire rings around foam cores of the same electrical parameters. Results show that the gain of the corner reflector of the invention with about nine reflector elements or less, is from 1 to 3 dB greater than that of a helix, often used for circular polarization, with an equal number of turns. The difference decreases as the number of elements increases.

One of the most important sets of parameters pertaining to communications reception is that group of data derivable from an antenna pattern. Of particular interest is the front-to-back (F/B) ratio and front-to-side (F/S) ratio, as these are directly related to the ability of the antenna system to reject interference and intermodulation from nearby stations, as well as the reflected products of the principal transmitting channel which lead to the reception of phase-shifted signals resulting in the familiar problem of "ghosts". This problem is particularly prevalent in urban centers, as there are greater numbers of surfaces capable of signal reflection.

The pattern of the grid-type corner reflector antenna is determined to a greater extent by the shape of the reflector than the dipole-vertex distance. A result of extended research was the development of a corner reflector antenna, without directors, with an absolute minimum F/B ratio of 20 dB. The effect on the radiation or reception pattern of differing numbers of directors D′ was then explored. The following table shows the F/B ratio and beamwidth as a function of number N of directors D′:

| N of Directors | 0 | 3 | 6 | 9 | 12 |
|---|---|---|---|---|---|
| F/B (dB) | 20 | 25 | 26 | 27 | 27 |
| Beamwidth θ° | 90 | 77 | 60 | 47 | 36 |

The antenna of the invention thus possesses excellent "ghost" rejection with circular polarization.

Further modifications will occur to those skilled in this art, such being considered to fall within the spirit and scope of the invention as defined in the appended claims.

What is claimed is:

1. A corner-reflector circularly polarized antenna system having, in combination, a corner reflector comprising a pair of pluralities of spaced parallel rods diverging from and parallel to a vertex axis; dipole means connected with transmission line means and oriented in a plane substantially parallel to but at an acute tilt angle to said axis, forward of the same and on a further axis orthogonal to the vertex axis and substantially bisecting the corner reflector; the spacing between the parallel rods at the portions of each of the said pluralities of rods to the sides of the dipole being greater than other rod spacings and adjusted to provide appropriate virtual image dipole action in the reflection from the rods to generate circular polarization.

2. A corner-reflector circularly polarized antenna system as claimed in claim 1 and in which director means is provided forward of the dipole means along the said further axis and having conducting surfaces with components substantially parallel and orthogonal to said vertex axis.

3. A corner-reflector circularly polarized antenna system as claimed in claim 2 and in which said director means comprises conductive disc means mounted centrally on said further axis.

4. A corner-reflector circularly polarized antenna system as claimed in claim 3 and in which said director disc means comprises a plurality of substantially circular discs spaced along said further axis.

5. A corner-reflector as claimed in claim 4 and in which the circumference of said discs is substantially the length of the wavelength of the frequency to be used with the antenna system.

6. A corner-reflector circularly polarized antenna system as claimed in claim 1 and in which said rods are of length about a wavelength λ of the frequency to be used with the antenna system, said dipole is approximately λ/2, said greater rod spacing is about λ/4 and the other spacing about λ/10, and the dipole is about 0.13λ to λ/4 in front of said vertex axis.

7. A corner-reflector circularly polarized antenna system as claimed in claim 1 and in which the angle of divergence of the corner reflector is substantially 65°–70° and the said acute angle of orientation of the dipole is substantially 25°–30°.

8. A corner-reflector circularly polarized antenna system as claimed in claim 1 and in which the said greater spacing is that between the rods of each of the diverging pluralities of parallel rods near the vertex axis, and the spacing between additional rods is substantially equal and less.

9. A corner-reflector circularly polarized antenna system as claimed in claim 8 and in which the said rods are of length about a wavelength λ of the frequency to be used with the antenna system, the said greater spacing is substantially λ/4, and the equal spacing is substantially λ/10.

10. A corner-reflector circularly polarized antenna system as claimed in claim 1 and in which the rods are centrally supported by a V-shaped boom and the dipole means is supported by a further boom extending from the apex of the V along the said further axis.

* * * * *